US005329417A

United States Patent [19]

Kniepkamp et al.

[11] Patent Number: 5,329,417

[45] Date of Patent: Jul. 12, 1994

[54] RELAY CONTROL CIRCUIT AND METHOD OF OPERATING SAME

[75] Inventors: David I. Kniepkamp, Fairview Heights, Ill.; Dwain F. Moore, Allegan County, Mich.; Bartholomew L. Toth, Crestwood; Bradley C. Zikes, St. Louis County, both of Mo.

[73] Assignee: Emerson Electric Co., St. Louis, Mo.

[21] Appl. No.: 730,470

[22] Filed: Jul. 16, 1991

[51] Int. Cl.[5] ..... H05B 1/02

[52] U.S. Cl. ..... 361/185; 361/3; 361/179; 361/2

[58] Field of Search ..... 361/2, 3, 185, 179; 323/235, 236, 319

[56] References Cited

U.S. PATENT DOCUMENTS

| | | | |
|---|---|---|---|
| 4,745,515 | 5/1988 | Fowler | 361/185 |
| 4,897,755 | 1/1990 | Polster et al. | 361/2 |
| 5,064,998 | 11/1991 | Holling | 219/519 |

*Primary Examiner*—Howard L. Williams
*Assistant Examiner*—Aditya Krishnan
*Attorney, Agent, or Firm*—Paul A. Becker, Sr.

[57] ABSTRACT

A method of operating a relay includes shifting, by a predetermined time increment each time the relay coil is energized, the time in the sine wave of the applied AC power source at which the relay coil is energized. The method further provides for similarly shifting the time in the sine wave at which the relay coil is de-energized. When applied to a system having two relays, the method includes providing such shifting to both relays and further includes providing a predetermined time delay between the time one relay is de-energized and the other relay is energized.

4 Claims, 4 Drawing Sheets

EXTERNAL INTERRUPT
100

DETERMINE SPEED
102
BOTH SPEEDS OFF
104
COOL SPEED
108
HEAT SPEED
106
IS COOL RELAY FLAG ON ?
136
YES
NO
TURN OFF HEAT RELAY FLAG
130
TURN OFF COOL RELAY FLAG
110
IS COOL RELAY FLAG ON ?
132
YES
NO
IS HEAT RELAY FLAG ON ?
138
YES
NO
IS HEAT RELAY FLAG ON ?
112
YES
NO
TURN ON COOL RELAY FLAG
134
TURN ON HEAT RELAY FLAG
114
TURN OFF HEAT RELAY FLAG
140
TURN OFF COOL RELAY FLAG
142

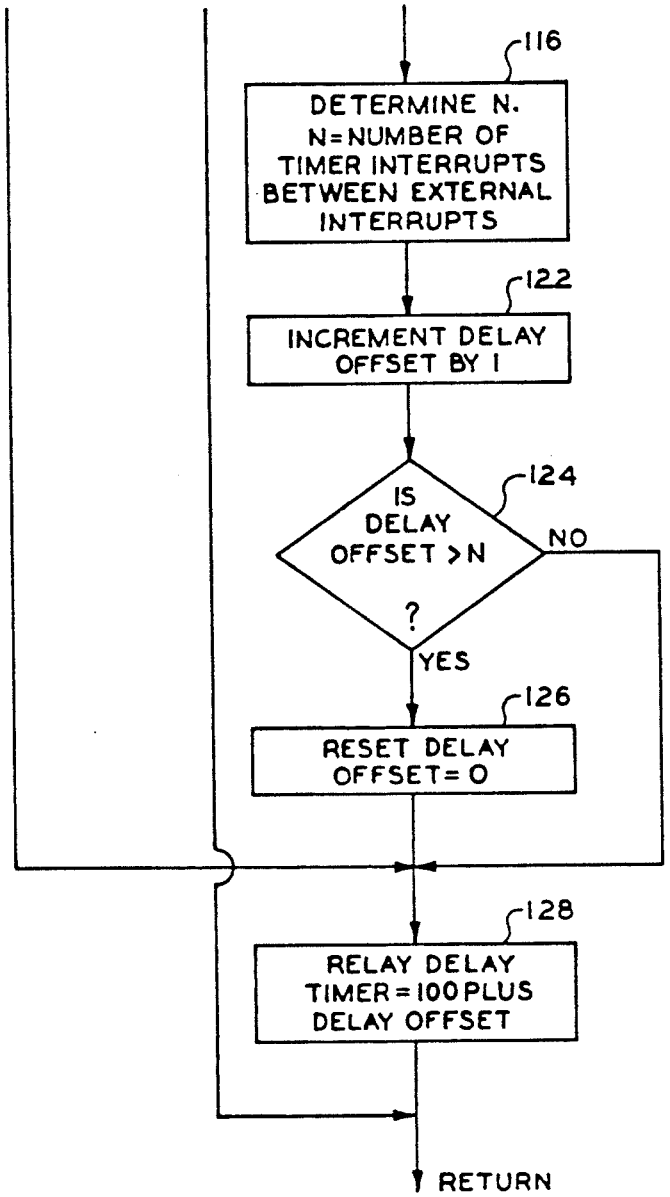
FIG. 2B
FIG. 4
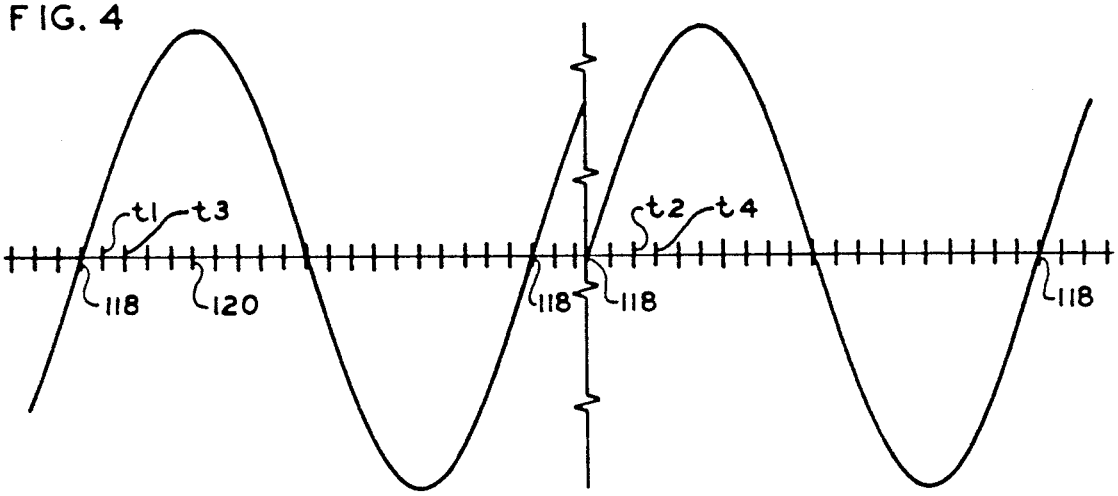

RELAY CONTROL CIRCUIT AND METHOD OF OPERATING SAME

BACKGROUND OF THE INVENTION

This invention relates to electrical circuits and methods used therein for controlling operation of electromechanical relays whose contacts control application of alternating current to an electrical load.

It is known in the art to embody microcomputers in various control systems such as in control systems for controlling heating and cooling apparatus. Typically, the microcomputer in such systems is synchronized with the applied AC (alternating current) power source for determining when, in the applied AC sine wave, the microcomputer will provide a particular output signal. For example, the structure of the microcomputer chip may be such that the microcomputer will provide a particular output signal when the applied AC sine wave is at its zero crossover point and increasing. Regardless of whether the determined time is at zero crossover or at some other specific time in the applied AC sine wave, the microcomputer will provide such signal repeatedly at the same determined time. While this manner of operation may be satisfactory for some functions, it creates a potential problem when used to control operation of electromechanical relays whose contacts control application of the AC source to an electrical load, and more particularly, to an electrical load which is highly inductive.

Specifically, when relay contacts initially close or make a circuit to an electrical load, they generally bounce to some degree. Such bouncing, wherein the contacts rapidly make and break the circuit, causes an electrical arc to be generated between the contacts. The relative strength of the arc is dependent upon the values of the voltage between and current through the contacts at the time the contacts break the circuit. It is noted that when the electrical load is an inductive device such as a motor, the starting current, which appears across the relay contacts when the contacts initially make, can typically be approximately two and one-half times greater than the running current. Thus, when the relay contacts control such a device, the resulting arc due to contact bounce can be appreciable. Furthermore, when relay contacts open or break a circuit to an electrical load to terminate energizing of the load, an electrical arc is also generated. Again, the relative strength of the arc is dependent upon the values of the voltage between and current through the contacts at the time the contacts break the circuit.

If the relay coil is energized in such a manner that the contacts make and break the electrical circuit at the times in the applied AC sine wave when the voltage and current are at their values for maximum power generation, a maximum strength arc is produced. If the relay contacts repeatedly make and break at such times when the arc is at maximum strength, the contacts can eventually weld together. In many relay applications, the relay is but one component of a multi-component control device and cannot be readily replaced. When the relay in such a device fails, the entire multi-component control device must be replaced, thus resulting in considerable cost to the user.

Thus, it is desirable to provide an electrical circuit and/or a method of operation which will minimize the tendency of the relay contacts to weld together. One approach in this regard has been to provide for energizing of the relay coil at a particular time in the AC sine wave which, as empirically determined, will result in the contacts making at the most favorable time in the AC sine wave, namely, when the values of the voltage across and current through the contacts are at their values for minimum power generation. Such an approach allows for the inherent time delay between the time the relay coil is energized and the time the contacts actually make. Such an approach also allows for a change in the time delay. Such time delay can change due to, for example, a change in the mechanical spring forces associated with the relay armature which actuates and/or carries the contacts. While such an approach appears satisfactory, it has a disadvantage of requiring a large number of circuit components to effect this function, thus resulting in a relatively expensive arrangement.

Another approach has been the use of a protective snubber circuit which is connected across the relay contacts. Such a snubber circuit, generally consisting of a resistor and a capacitor, adds considerable cost to the product, especially when there are more than one set of relay contacts to be so protected.

Another approach has been the use of a random cycling routine incorporated in the program of a microcomputer. In such a routine, the time in the applied AC sine wave at which the relay coil is energized and/or de-energized is randomly determined. Due to the inherent nature of random cycling, the effect thereof is unpredictable. Also, a random cycling routine requires a large amount of software code, thus possibly requiring the use of a more expensive microcomputer chip than would otherwise be required.

SUMMARY OF THE INVENTION

A method of operating a relay is disclosed which includes shifting, by a predetermined time increment each time the relay coil is energized, the time in the sine wave of the applied AC power source at which the relay coil is energized.

Another feature of the disclosed method is to apply such shifting to the time in the sine wave at which the relay coil is de-energized.

Yet another feature of the disclosed method is to apply such shifting to two relays and to further provide a predetermined minimum time delay between the time one relay is de-energized and the other relay is energized.

The above mentioned and other features of the present invention will become apparent from the following description when read in conjunction with the accompanying drawings.

BRIEF DESCRIPTION OF THE DRAWINGS

FIGS. 2A and 2B, when combined, is a flow chart depicting the logic sequence of an external interrupt routine programmed into and executed by the microcomputer in the system of FIG. 1;

FIG. 4 is a graph relating to various time-based functions with respect to the sine wave of the AC power source applied to the system of FIG. 1.

DESCRIPTION OF THE PREFERRED EMBODIMENT

While the illustrated embodiment relates to a heating and cooling system, it is to be understood that the teachings of the present invention can be embodied in various other systems wherein electromechanical relays control application of AC to an electrical load.

Figure 1:
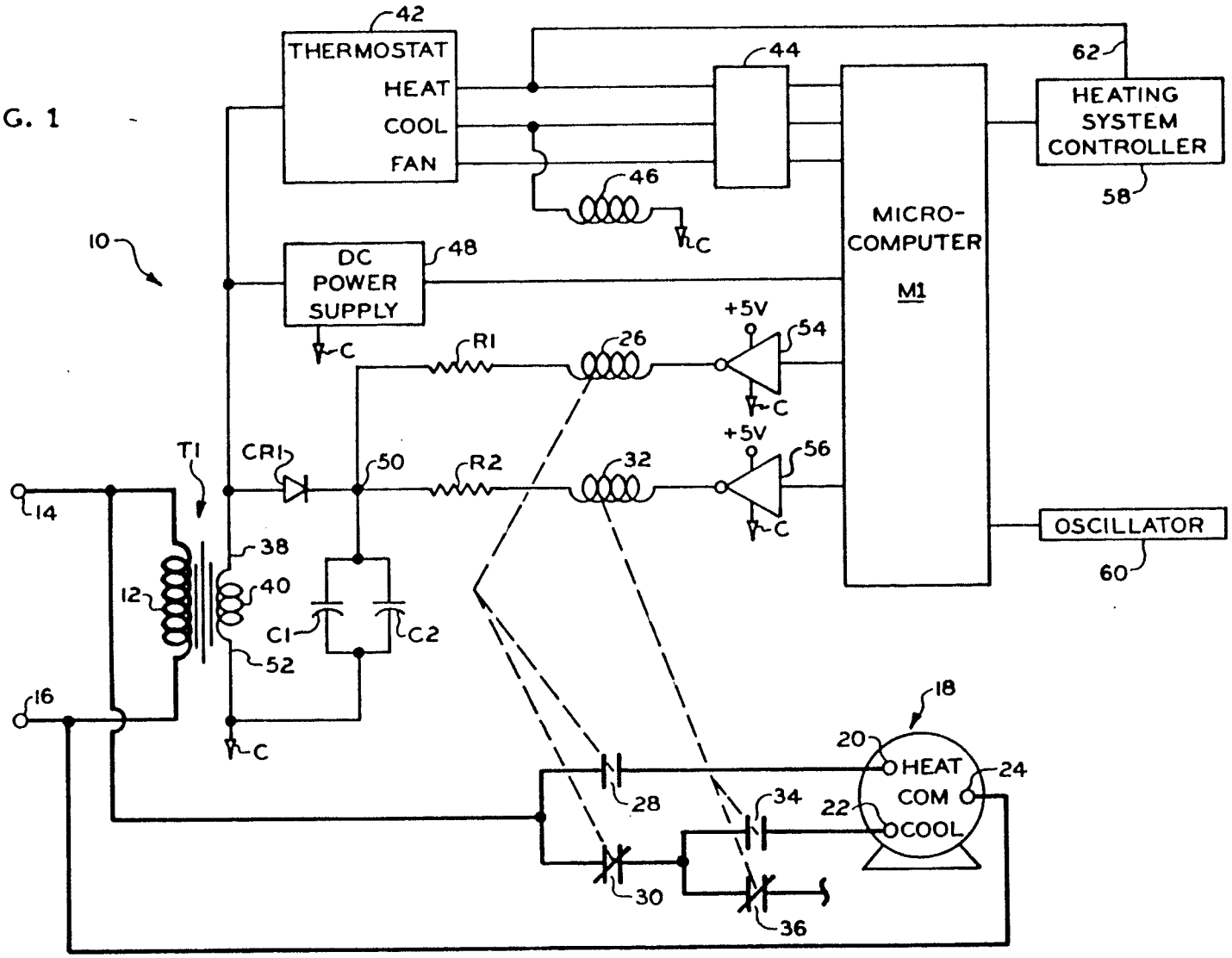
FIG. 1 is a schematic illustration, largely in block form, of a heating and cooling system incorporating the present invention.

Referring to FIG. 1, a heating and cooling system is indicated generally at 10. System 10 includes a voltage step-down transformer T1 having a primary winding 12 connected to terminals 14 and 16 of a conventional 120 volt AC power source.

Shown generally at 18 is a two-speed motor which drives a blower (not shown) which circulates conditioned air throughout the dwelling. Motor 18 has an input terminal 20 for providing a first speed during the heating mode, an input terminal 22 for providing a second speed during the cooling mode, and a common terminal 24. One of the two speeds is also used when continuous blower operation is desired.

A first relay comprises a relay coil 26 and normally-open contacts 28 and normally-closed contacts 30. A second relay comprises a relay coil 32 and normally-open contacts 34 and normally-closed contacts 36. Terminal 20 of motor 18 is connected to terminal 14 of the AC power source through relay contacts 28; terminal 22 of motor 18 is connected to terminal 14 through relay contacts 30 and 34. Relay contacts 36 provide no function in the embodiment shown.

One end 38 of the secondary winding 40 of transformer T1 is connected to a thermostat 42. Thermostat 42 provides signals through a buffer 44 to a microcomputer M1, such signals being indicative of a demand or no demand for heating, cooling, and/or fan functions. (The word "fan" refers to the blower operated by motor 18.) The operating coil 46 of a contactor for controlling cooling apparatus such as a compressor (not shown) is connected between the COOL output of thermostat 42 and chassis common C, hereinafter referred to as common C.

End 38 of secondary winding 40 is also connected to a DC power supply 48. DC power supply 48 is effective to provide a stable 5-volt power supply for microcomputer M1 and for various other circuit components.

End 38 of secondary winding is also connected through a controlled rectifier CR1 to a junction 50. Capacitors C1 and C2 are connected in parallel between junction 50 and the other end 52 of secondary winding 40, which end 52 is connected to common C. Capacitors C1 and C2 filter the half-wave power supply provided by rectifier CR1 so as to establish a filtered unidirectional power source at junction 50.

A dropping resistor R1 and relay coil 26 are connected in series between junction 50 and the output pin of an inverter 54. A dropping resistor R2 and relay coil 32 are connected in series between junction 50 and the output pin of an invertor 56. The input pins of inverters 54 and 56 are connected to microcomputer M1.

Also connected to microcomputer M1 are a heating system controller 58 and an oscillator 60. Heating system controller 58 comprises various circuitry to effect control of, for example, a gas valve and ignition means in a conventional gas-fired furnace (not shown). Portions of heating system controller 58 are also directly responsive to the HEAT output of thermostat 42 as indicated by line 62. Oscillator 60, typically including a quartz crystal, establishes the machine cycle time. Oscillator 60 also provides for various timing functions such as external interrupts and timer interrupts, the functions of which will be hereinafter described.

Microcomputer M1, preferably in the MC68HC05 family of chips, is programmed to provide a desired method of operating heating and cooling system 10. While the method of operating entails many steps, only those portions critical to an understanding of the present invention will be described in detail.

Briefly, when thermostat 42 determines that heating is required, it provides a signal to microcomputer M1 and to heating system controller 58. In response to such signal, microcomputer M1 provides output signals to heating system controller 58 to initiate the heating cycle. A typical heating cycle begins with a pre-purge wherein an inducer blower (not shown) operates to purge the combustion chamber of the furnace of any unburned fuel or products of combustion present in the combustion chamber. After pre-purge, a hot surface igniter (not shown) is energized. When the igniter is hot enough to ignite gas, a gas valve (not shown) is opened to allow gas to flow to the burner. Ignition occurs and, after a predetermined time, microcomputer M1 provides a logic high signal to the input of invertor 54. With such a logic high signal on the input, the output of invertor 54 is low, enabling relay coil 26 to be energized by the unidirectional power source at junction 50. With relay coil 26 energized, its controlled contacts 28 close, thus enabling motor 18 to run at the heating speed, hereinafter referred to as the HEAT speed. When thermostat 42 is satisfied, it no longer provides a signal to microcomputer M1 or to heating system controller 58. In response, the gas valve closes. A post-purge period is then provided by microcomputer M1 wherein the inducer blower continues to run to purge the combustion chamber. Finally, after a predetermined time, microcomputer M1 provides a logic low signal to the input of invertor 54. The output of invertor 54 is then high, causing relay coil 26 to be de-energized and effect opening of its contacts 28.

When thermostat 42 determines that cooling is required, it provides a signal to microcomputer M1 and also provides an energizing circuit to contactor coil 46. With contactor coil 46 energized, the compressor is turned on. The signal to microcomputer M1 causes microcomputer M1 to provide a logic high signal to the input of invertor 56. With such a logic high signal on the input, the output of invertor 56 is low, enabling relay coil 32 to be energized by the unidirectional power source at junction 50. With relay coil 32 energized, its controlled contacts 34 close, thus enabling motor 18 to run at the cooling speed, hereinafter referred to as the COOL speed. When thermostat 42 is satisfied, contactor coil 46 is de-energized whereby the compressor is turned off. Also, a signal is no longer provided to microcomputer M1. After a predetermined time, microcomputer M1 provides a logic low signal to the input of invertor 56. The output of invertor 56 is then high, causing relay coil 32 to be de-energized and effect opening of its contacts 34.

When thermostat 42 establishes a demand for continuous fan operation, it provides a signal to microcomputer M1. In response to such signal, microcomputer M1 provides a logic high signal to the input of invertor 56 whereby relay coil 32 is energized. With relay coil 32 energized, its contacts 34 close, thus enabling motor 18 to run at the COOL speed.

Figure 2A:
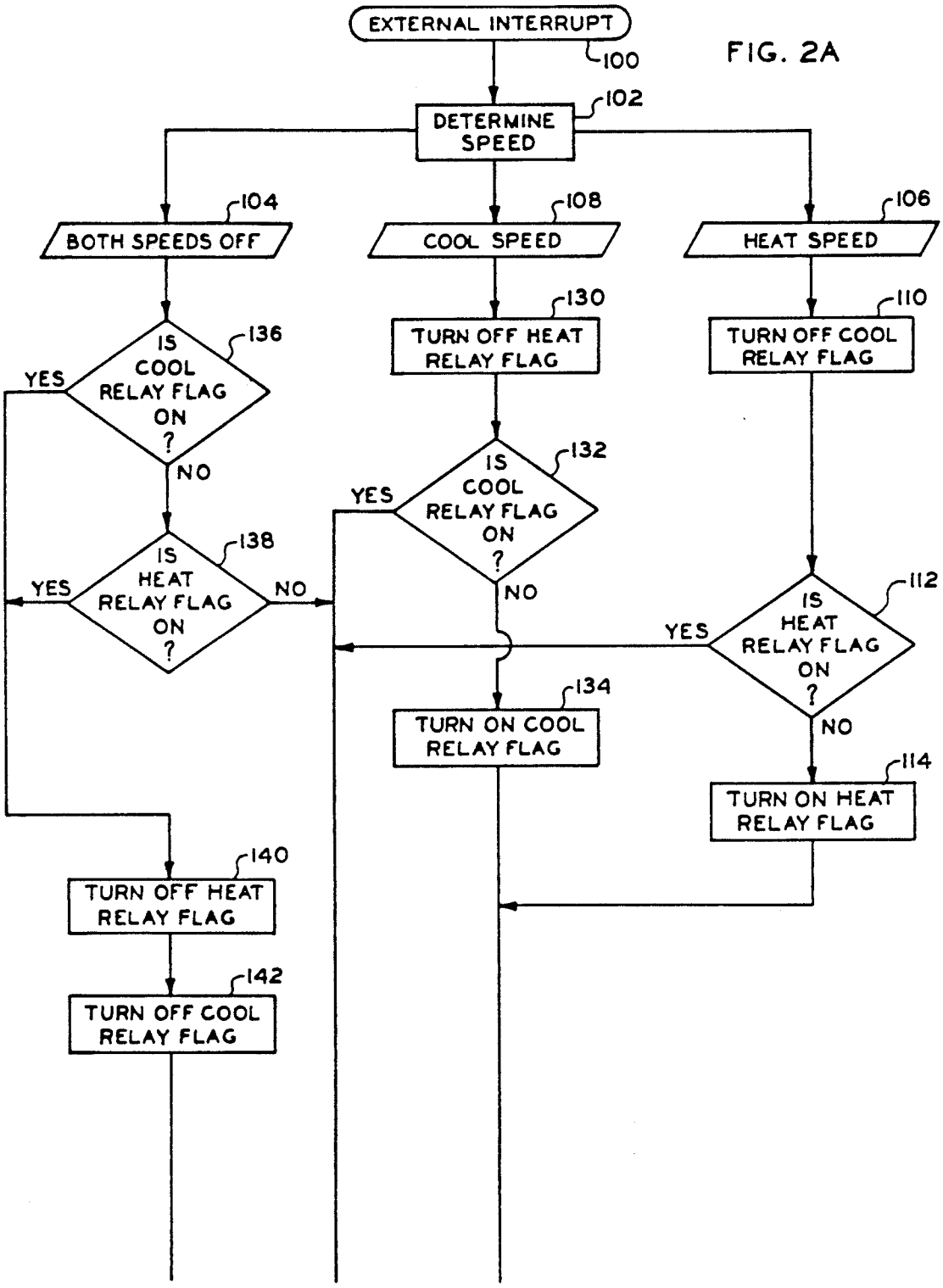

Referring to FIG. 2A, microcomputer M1 is programmed to execute an EXTERNAL INTERRUPT routine 100 every line cycle of the AC power source. Thus, if the source is 60 Hz, the routine 100 is executed every approximately 16 milliseconds.

The first step 102 in EXTERNAL INTERRUPT routine 100 is to determine the speed at which motor 18 is to be operated. Specifically, when thermostat 42 calls for heating, the previously described heating cycle is initiated. Step 104, wherein both the HEAT speed and the COOL speed are off, is in effect. A predetermined time after burner flame appears, step 106 is in effect to provide for operation of motor 18 at the HEAT speed. When thermostat 42 no longer calls for heating, step 106 remains in effect for a predetermined time after burner flame is extinguished. When the predetermined time expires, step 104 is again in effect. When thermostat 42 calls for cooling, step 108 is in effect to provide for operation of motor 18 at the COOL speed. When thermostat 42 no longer calls for cooling, step 108 remains in effect for a predetermined time after which step 104 is again in effect. When thermostat 42 calls for continuous fan operation, step 108 is in effect.

If HEAT speed 106 is determined, the first logic step 110 is to turn off the cool relay flag. The heat relay flag is then checked in step 112. If the heat relay flag is not on, it is turned on in step 114. After step 114, the logic proceeds to step 116 in FIG. 2B wherein microcomputer M1 determines the number N of timer interrupts between external interrupts. Referring to FIG. 4, the previously described external interrupts which occur every approximately 16 milliseconds when the AC power source is 60 Hz, are shown at 118. The timer interrupts, indicated at 120, are established by microcomputer M1 to occur every approximately 833 microseconds. Thus, when the AC power source is 60 Hz, the number N of timer interrupts 120 is twenty. (It is noted that when the AC power source is 50 Hz, the number N of timer interrupts 120 is twenty-four.

After the number N of timer interrupts 120 is determined in step 116, a delay offset counter is incremented by a count of one in step 122. The count value of the delay offset counter is checked in step 124. If the count value is greater than twenty (for 60 Hz), the counter is reset to zero in step 126; if the count value is not greater than twenty, the reset step 126 is bypassed. The logic then proceeds to step 128 wherein a relay delay timer is loaded with a value of one hundred plus the count value of the delay offset counter. The value of one hundred defines one hundred of the 833-microsecond timer interrupts 120. The EXTERNAL INTERRUPT routine 100 then returns to the main program.

It is noted that if the heat relay flag is on in step 112, the logic flows directly to RETURN.

If COOL speed 108 is determined, the first logic step 130 is to turn off the heat relay flag. The cool relay flag is then checked in step 132. If the cool relay flag is not on, it is turned on in step 134. The logic then proceeds to steps 116, 122, 124, 126, and 128 as previously described for the HEAT speed 106 logic. It is noted that if the cool relay flag is on in step 132, the logic flows directly to RETURN.

If both the HEAT speed and COOL speed are to be off, the logic proceeds from step 104 to step 136 wherein the cool relay flag is checked. If it is not on, the heat relay flag is checked in step 138. If the heat relay is not on in step 138, the logic proceeds to RETURN. If either the cool relay flag or the heat relay flag is on in steps 136 and 138, it is turned off in steps 140 or 142. The logic then proceeds to step 128 in FIG. 2B.

Figure 3:
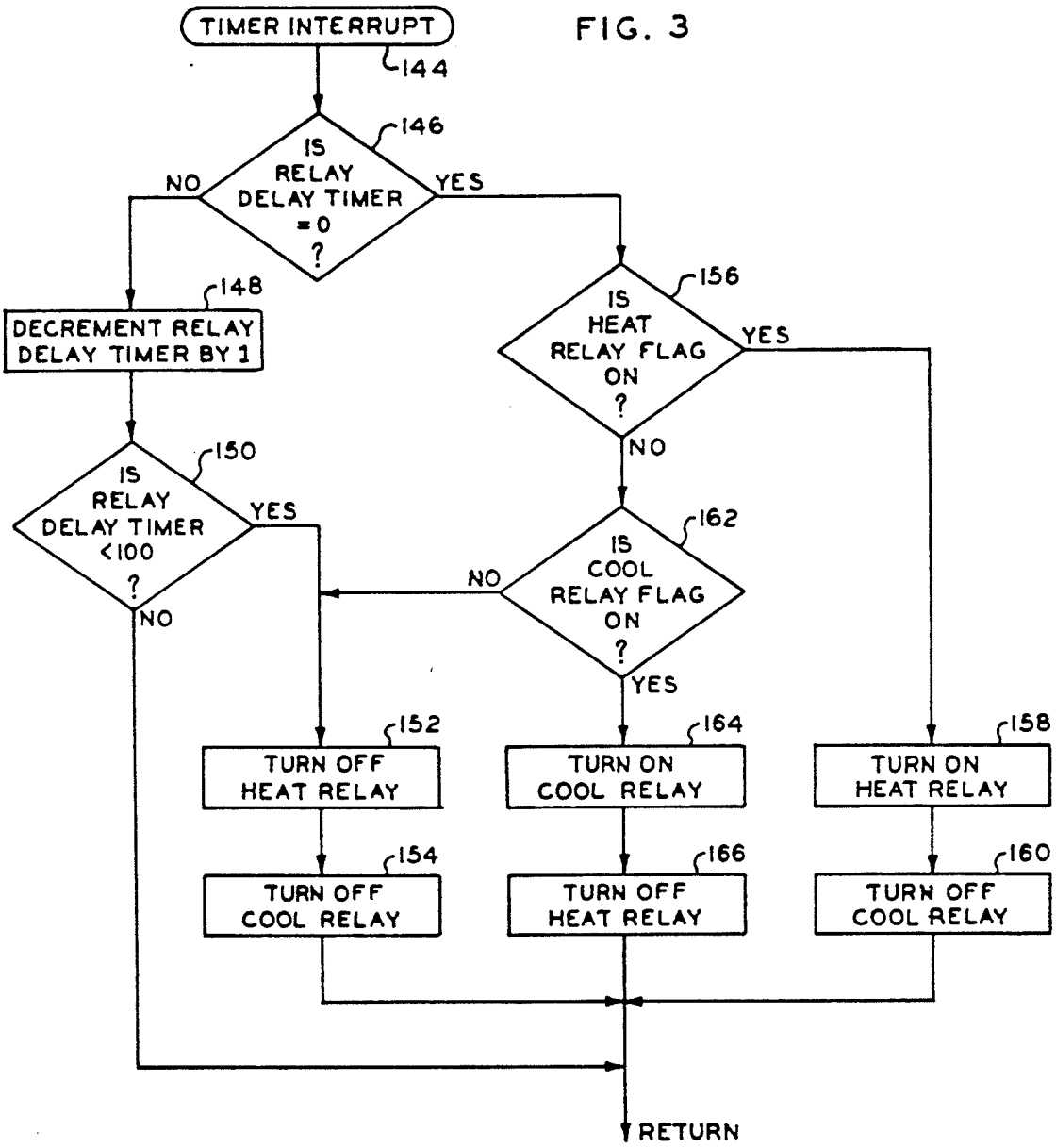
FIG. 3 is a flow chart depicting the logic sequence of a timer interrupt routine programmed into and executed by the microcomputer in the system of FIG. 1.

Referring to FIG. 3, the first logic step in the TIMER INTERRUPT routine 144 is a check of whether the count in the relay delay timer is zero in step 146. If the count is not zero, the count in the timer is decremented by one in step 148. The next logic step is a check of whether the count in the relay delay timer is less than one hundred in step 150. If the count is not less than one hundred, the logic flows directly to RETURN; if the count is less than one hundred, the heat relay and the cool relay are turned off in step 152 and 154, and the logic then returns to the main program.

If the count in the relay delay timer is zero in step 146, the heat relay flag is checked in logic step 156. If the heat relay flag is on, the heat relay is turned on in step 158 and the cool relay is turned off in step 160. The logic then flows to RETURN. If the heat relay flag is not on in step 156, the cool relay flag is checked in step 162. If the cool relay flag is on in step 162, the cool relay is turned on in step 164 and the heat relay is turned off in step 166. The logic then flows to RETURN. If the cool relay flag is not on in step 162, the heat relay is turned off in step 152 and the cool relay is turned off in step 154. The logic then flows to RETURN. It is noted that the heat relay in steps 152, 158, and 166 refers to relay coil 26 and its contacts 28 and 30, and that the cool relay in steps 154,160, and 164 refers to relay coil 32 and its contacts 34 and 36.

Assume, for example, that thermostat 42 initiates a call for heating. After burner flame has existed for a predetermined time, it is determined in step 102 that HEAT speed 106 is to be established. The cool relay flag is turned off in Step 110. The heat relay flag would be off in step 112 and the heat relay flag would therefore be turned on in step 114. If the AC power source at terminals 14 and 16 is 60 Hz, the number N of timer interrupts 120 is a value of twenty. Assume that the present call for heating is the first call after the system 10 is connected to the AC power source. Under this assumption, the delay offset counter in step 122 is incremented from a count of zero to a count of one. In accordance with step 128, the relay delay timer is then loaded with a count value of one hundred and one.

Referring to FIG. 3, at the first execution of TIMER INTERRUPT routine 144 after the first execution of EXTERNAL INTERRUPT routine 100 in which the relay delay timer is loaded with the count value of one hundred and one, the count value is decremented by a count of one in step 148. Since the count is then one hundred, the logic flows to RETURN. At the next execution of TIMER INTERRUPT routine 144, the count is ninety-nine whereby the heat relay and cool relay are turned off in steps 152 and 154. The turning off in steps 152 and 154 is redundant at this time since the heat relay and cool relay are already off.

At the next execution of EXTERNAL INTERRUPT routine 100, the heat relay flag is on in step 112 whereby the steps of incrementing the delay offset and loading of the relay delay timer are bypassed. Since TIMER INTERRUPT routine 144 will have been executed twenty times since the previous execution of EXTERNAL INTERRUPT routine 100, the count value in the relay delay timer will have decremented from a count value of one hundred and one to a value of eighty-one. After four additional executions of EXTERNAL INTERRUPT routine 100, the count value will have decremented to a value of one. Therefore, at the next execution of TIMER INTERRUPT routine 144, the count value will be zero. Since the heat relay flag is on, logic step 156 dictates that the heat relay is to be turned on in step 158 and the cool relay is to be turned off in step 160. Accordingly, relay coil 26 is energized to close its contacts 28 and thereby effect energizing of motor 18 at the HEAT speed. The time at which such energizing occurs, with respect to the sine wave of the AC power source, is shown at t1 in FIG. 4.

When thermostat 42 terminates the call for heating, the gas valve closes. After burner flame has been absent for a predetermined time, it is determined in step 102 that both the HEAT speed and COOL speed should be off. Since the heat relay flag is on in step 138, it is turned off in step 140. The cool relay flag is also turned off in step 142. In accordance with step 128, the relay delay timer is then loaded with the same count value it was previously loaded with, namely, one hundred and one.

In accordance with the TIMER INTERRUPT routine 144, when the count in the relay delay timer has decremented to a value of ninety-nine, the heat relay is turned off in step 152 and the cool relay is turned off in step 154. Accordingly, relay coil 26 is de-energized to open its contacts 28 and thereby de-energize the HEAT speed of motor 18. Since the loading of the relay delay timer occurs at execution of EXTERNAL INTERRUPT routine 100, it requires two executions of TIMER INTERRUPT routine 144 thereafter to effect the decrementing of the count value from one hundred and one to the value of ninety-nine. Therefore, referring to FIG. 4, the time at which such de-energizing occurs is two timer interrupts 120 after external interrupt 118, such time being indicated at time t2.

On the next call for heating, the delay offset counter in step 122 is incremented to a count of two. The relay delay timer will then be loaded with a count value of one hundred and two in step 128. In accordance with the logic of EXTERNAL INTERRUPT routine 100 and TIMER INTERRUPT routine 144, energizing of relay coil 26 will then occur at one timer interrupt 120 later than in the previous call for heating, such time being shown at t3 in FIG. 4. Similarly, the de-energizing of relay coil 26 will then occur at one timer interrupt 120 later than in the previous termination of the call for heating, such time being shown at t4 in FIG. 4.

On each subsequent call for heating, the delay offset counter is incremented by a count of one in accordance with step 122. In accordance with steps 124 and 126, the counter is reset to zero when the count value exceeds twenty. Thus, on each subsequent call for heating, the times at which energizing and de-energizing of relay coil 26 occur and thus the times at which the relay contacts 28 open and close are incremented or shifted by 833 microseconds.

The 833-microsecond shift ensures that relay contacts 28 will not repetitively make the circuit to the HEAT speed winding at the same time in the sine wave of the AC power source nor repetitively break the circuit at the same time. It is obvious that there will be a specific time in each half-wave of the sine wave at which the voltage and current will be at their values for maximum power generation, resulting in a maximum strength arc at the relay contacts 28. However, such a condition will only occur at one specific time in each half-wave of the sine wave. That is to say, in the large majority of times, the voltage and current values will be less than their values for maximum power operation whereby a less than maximum strength arc will be produced. It is believed that such a manner of operation greatly minimizes the tendency of the relay contacts 28 to weld.

It should be apparent, in view of the foregoing detailed description with regard to the heating relay coil 26, that the EXTERNAL INTERRUPT routine 100 and the TIMER INTERRUPT routine 144 will provide the same 833-microsecond shift with regard to operating cooling relay coil 32.

It should be noted that the base count of one hundred in the relay delay timer ensures that the normally-open contacts 34, rather than the normally-closed contacts 30, will perform the making and breaking of the electrical circuit to the COOL speed winding of motor 18. Such a method of operation is desirable since, typically, normally-open contacts are constructed in such a manner that they can withstand a greater electrical arc than can be withstood by normally-closed contacts.

Specifically, the COOL speed winding of motor 18 could be presently energized due to a call by thermostat 42 for continuous fan operation. Under this condition, the count in the relay delay timer has decremented to zero. In accordance with steps 146, 156, 162, 164, and 166, cool relay coil 32 is presently energized whereby its normally-open contacts 34 are closed, and heat relay coil 26 is de-energized whereby its normally-closed contacts 30 are closed. If there is a call for heating while continuous fan operation is in effect, the heat relay flag is turned on in step 114 which effects loading of the relay delay timer with the count value of one hundred plus the delay offset value in step 128. In accordance with steps 146, 148, 150, 152, and 154, the cool relay coil 32 is de-energized. Since at this specific time, heat relay coil 26 is already de-energized, it remains de-energized. When cool relay coil 32 is de-energized, it effects opening of its controlled contacts 34 whereby the COOL speed is de-energized. In accordance with steps 146, 156, 158, and 160, the count in the relay delay timer must equal zero before the heat relay coil 26 is energized. As previously described, it requires approximately five line cycles for the count value to reach zero. When the count equals zero, heat relay coil 26 is energized, effecting opening of its normally-closed contacts 30 and closing of its normally-open contacts 28. The closing of contacts 28 effects energizing of the HEAT speed winding. Since the circuit to the COOL speed winding was already broken by the opening of contacts 34, contacts 30 break a dry circuit.

In view of the foregoing description, it should be apparent that when switching from HEAT speed to COOL speed, heat relay coil 26 would be de-energized before cool relay coil 32 is energized whereby contacts 30 would make before contacts 34 make. Under this condition, therefore, contacts 30 would make a dry circuit.

It should be understood that the incremental time shift described herein could be utilized in systems wherein only one relay controls the application of AC power to an electrical load. It should also be understood that the incremental time shift described herein could be utilized on only the contact making or only on the contact breaking function rather than on both. It should be further understood that the circuitry and method of operating relay coils 26 and 32 described herein could be expanded to include additional relays. For example, if motor 18 were a three-Speed motor, another relay coil having its normally-open contacts in series with the normally-closed contacts 36 could be added.

While the invention has been illustrated and described in detail in the drawings and foregoing description, it will be recognized that many changes and modifications will occur to those skilled in the art. It is therefore intended, by the appended claims, to cover any such changes and modifications as fall within the true spirit and scope of the invention.

We claim:

1. In an electrical circuit including a relay having a coil and a set of contacts which contacts control the application of electrical power from an AC power source to an electrical load, an improved method of operating the relay wherein the improvement comprises:

establishing upon an initial demand for operation of the relay coil to effect a change in state of the contacts from one state to another, a time in the sine wave of the AC power source at which said relay coil is so operated;

upon the next demand for said operation of said relay coil, shifting said time by a predetermined time increment from said time relating to said initial demand; and upon each subsequent demand for said operation of said relay coil, shifting said time by said predetermined time increment from said time relating to the demand immediately previous to the instant demand.

2. In an electrical circuit including a relay having a coil and a set of normally-open contacts which contacts control the application of electrical power from an AC power source to an electrical load, an improved method of operating the relay wherein the improvement comprises:

establishing, upon an initial demand for operation of the relay coil, a time in the sine wave of the AC power source at which said relay coil is energized so as to cause the normally-open contacts to close;

establishing, upon termination of said initial demand, a time in said sine wave of said AC power source at which said relay coil is de-energized so as to cause said normally-open contacts to open;

upon the next demand for said operation of said relay coil, shifting said time at which said relay coil is energized by a predetermined time increment from said time relating to said initial demand; and upon each subsequent demand for said operation of said relay coil, shifting said time at which said relay coil is energized by said predetermined time increment from said time relating to the demand immediately previous to the instant demand.

3. In an electrical circuit including two relays, a first one of the relays having a coil and a set of normally-open contacts and a set of normally-closed contacts, a second one of the relays having a coil and at least a set of normally-open contacts, the normally-open contacts of the first one of the relays being directly connected to a first electrical load to control the application of electrical power thereto from an AC power source, the normally-closed contacts of the first one of the relays being connected in series with the normally-open contacts of the second one of the relays to control the application of electrical power from the AC power source to a second electrical load, an improved method of operating the relays wherein the improvement comprises:

establishing, upon an initial demand for operation of either of the relays to effect a change in state of its contacts from one state to another, a time in the sine wave of the AC power source at which said either of the relays is so operated;

upon the next demand for said operation of said either of the relays, shifting said time by a predetermined time increment from said time relating to said initial demand;

upon each subsequent demand for said operation of said either of the relays, shifting said time by said predetermined time increment from said time relating to the demand immediately previous to the instant demand; and upon demand for energizing of one of the relay coils while the other of the relay coils is energized, de-energizing said other of the relay coils and delaying energizing of said one of the relay coils for a predetermined time after said de-energizing of said other of the relay coils.

4. The method in claim 2 further including, upon termination of said next demand, shifting said time at which said relay coil is de-energized by said predetermined time increment from said time relating to said termination of said initial demand, and, upon termination of said each subsequent demand, shifting said time at which said relay coil is de-energized by said predetermined time increment from said time relating to termination of the demand immediately previous to the instant demand.

* * * * *